US010371374B2

(12) United States Patent
Qiu

(10) Patent No.: US 10,371,374 B2
(45) Date of Patent: Aug. 6, 2019

(54) MULTI-CONE, MULTI-STAGE SPRAY NOZZLE

(71) Applicant: FISHER CONTROLS INTERNATIONAL LLC, Marshalltown, IA (US)

(72) Inventor: Yan Qiu, Marshalltown, IA (US)

(73) Assignee: FISHER CONTROLS INTERNATIONAL LLC, Marshalltown, IA (US)

( * ) Notice: Subject to any disclaimer, the term of this patent is extended or adjusted under 35 U.S.C. 154(b) by 191 days.

(21) Appl. No.: 15/251,636

(22) Filed: Aug. 30, 2016

(65) Prior Publication Data

US 2018/0058685 A1 Mar. 1, 2018

(51) Int. Cl.
*F22G 5/12* (2006.01)
*B01F 3/04* (2006.01)
(Continued)

(52) U.S. Cl.
CPC ..... *F22G 5/126* (2013.01); *B01F 3/04049* (2013.01); *B05B 1/304* (2013.01); *B05B 1/3006* (2013.01); *B05B 1/3013* (2013.01); *B05B 1/3073* (2013.01); *B05B 1/323* (2013.01); *B05B 12/04* (2013.01); *F22G 5/123* (2013.01)

(58) Field of Classification Search
CPC ..... B05B 1/1609; B05B 12/04; B05B 1/323; B05B 1/3073; B05B 1/3006; B05B 1/3013; B05B 1/304; F22G 5/126; F22G 5/123; B01F 3/04049
See application file for complete search history.

(56) References Cited

U.S. PATENT DOCUMENTS 1,876,980 A * 9/1932 Lentell, Jr. ..... F02M 61/08 239/466
2,063,709 A * 12/1936 Leonard ..... F02M 61/08 239/453
(Continued)

FOREIGN PATENT DOCUMENTS

CA 2808957 A1 * 9/2013 ..... B23P 19/04
DE 4213826 A1 * 11/1992 ..... B05B 1/3066
(Continued)

OTHER PUBLICATIONS

International Search Report and Written Opinion of the International Searching Authority for application No. PCT/US2017/047881, dated Nov. 2, 2017.

*Primary Examiner* — Stephen Hobson
(74) *Attorney, Agent, or Firm* — Marshall, Gerstein & Borun LLP

(57) ABSTRACT

A multi-cone, multi-stage spray nozzle includes a nozzle body and outer and inner valve stems. The nozzle body defines an outer valve seat disposed at its distal end. The outer valve stem is slidably disposed in the nozzle body. The inner valve stem is slidably disposed in the outer valve stem. The inner valve stem occupies an open position and the outer valve stem occupies a closed position upon the application of a first pressure on the distal ends of the inner and outer valve stems. And, the inner and outer valve stems both occupy open positions upon the application of a second pressure that is greater than the first pressure on the distal ends of the inner and outer valve stems.

28 Claims, 5 Drawing Sheets

(51) Int. Cl.

| | |
|---|---|
| ***B05B 1/30*** | (2006.01) |
| ***B05B 1/32*** | (2006.01) |
| ***B05B 12/04*** | (2006.01) |

(56) References Cited

U.S. PATENT DOCUMENTS 2,127,188 A * 8/1938 Schellin ..... B05B 1/1609 239/440
2,313,994 A * 3/1943 Grant ..... B05B 1/1609 239/440
2,320,964 A * 6/1943 Yates ..... B05B 1/005 15/405
2,801,881 A * 8/1957 Campbell ..... B05B 1/323 239/464
3,737,105 A * 6/1973 Arnold ..... B05B 1/06 239/423
3,850,373 A * 11/1974 Grolitsch ..... B01D 1/20 239/499
4,197,997 A * 4/1980 Wu ..... F02M 45/086 239/102.1
4,512,520 A * 4/1985 Schoonover ..... B05B 1/265 239/440
4,958,771 A * 9/1990 Klomp ..... F02M 61/08 239/453
4,991,780 A * 2/1991 Kannan ..... B05B 1/323 239/440
5,357,914 A * 10/1994 Huff ..... F01L 1/285 123/188.2
5,862,992 A * 1/1999 Stinson ..... B01D 19/0015 239/440
6,729,351 B2 * 5/2004 Bircann ..... F16K 1/443 123/568.2
6,746,001 B1 * 6/2004 Sherikar ..... F22G 5/123 122/487
7,296,545 B2 * 11/2007 Ellingsen, Jr. ..... F01L 1/28 123/188.2
7,654,509 B2 * 2/2010 Freitas ..... B05B 1/06 261/62
8,327,831 B2 * 12/2012 Sturman ..... F01L 1/28 123/525
8,800,895 B2 * 8/2014 Hicks ..... F23D 11/38 239/533.2
8,955,773 B2 * 2/2015 Watson ..... F22G 5/123 137/542
9,631,855 B2 * 4/2017 Dodson ..... B05B 1/02
2008/0308064 A1 * 12/2008 Yudanov ..... F02M 45/02 123/296
2012/0138710 A1 * 6/2012 Hicks ..... B05B 1/3013 239/455
2014/0091485 A1 * 4/2014 Watson ..... F22G 5/123 261/66
2014/0252125 A1 * 9/2014 Mastrovito ..... B05B 1/14 239/302
2016/0033124 A1 * 2/2016 Giove ..... F22G 5/123 261/78.2

FOREIGN PATENT DOCUMENTS

DE 102007054673 A1 * 5/2009 ..... B05B 1/1609
EP 0501164 A1 9/1992
EP 2415533 A1 * 2/2012 ..... B05B 1/323
WO WO-2013077849 A1 * 5/2013 ..... B05B 1/3073

* cited by examiner

MULTI-CONE, MULTI-STAGE SPRAY NOZZLE

FIELD OF THE DISCLOSURE

The present disclosure is related to spray nozzles and, more particularly, to spray nozzles for steam conditioning devices such as desuperheaters and steam conditioning valves.

BACKGROUND

Steam conditioning devices (e.g., desuperheaters and steam conditioning valves) are used in many industrial fluid and gas lines to reduce the temperature of superheated process fluid and gas to a desired set point temperature. For example, desuperheaters are used in power process industries to cool superheated steam. The desuperheater utilizes nozzles to inject a fine spray of atomized cooling water or other fluid, which can be referred to as a spraywater cloud, into the steam pipe through which the process steam flows. Evaporation of the water droplets in the spraywater cloud reduces the temperature of the process steam. The resulting temperature drop can be controlled by adjusting the characteristics of the spraywater cloud by adjusting one or more control variables, such as the flow rate, pressure and/or temperature of the cooling water being forced through the nozzles. But the adjustability of these control variables can be limited based on the mechanics of the nozzles themselves. For example, a nozzle equipped for high flow rate and/or high pressure conditions may not properly function at low flow rate and/or low pressure conditions. Thus, the operating range for any given set of nozzles must be considered when designing a steam conditioning device for any given application.

SUMMARY

One aspect of the present disclosure provides a spray nozzle including a nozzle body, an outer valve stem, an inner valve stem, an outer bias device, and an inner bias device. The nozzle body has a proximal end, a distal end, a first through bore extending between the proximal and distal ends of the nozzle body, and an outer valve seat disposed at the distal end of the nozzle body. The outer valve stem is slidably disposed relative to the first through bore of the nozzle body and includes a proximal end, a distal end, and an outer valve head. The outer valve head carries an inner valve seat at the distal end of the outer valve stem, and a second through bore extends through at least a distal portion of the outer valve stem. The outer valve head is adapted to engage the outer valve seat of the nozzle body when the outer valve stem is in a closed position and adapted to be spaced away from the outer valve seat of the nozzle body when the outer valve stem is in an open position. The an inner valve stem is slidably disposed relative to the second through bore of the outer valve stem and includes a proximal end, a distal end, and an inner valve head disposed at the distal end of the inner valve stem. The inner valve head is adapted to engage the inner valve seat when the inner valve stem is in a closed position and adapted to be spaced away from the inner valve seat when the inner valve stem is in an open position. The outer bias device generates a first force biasing the outer valve head of the outer valve stem toward the outer valve seat of the nozzle body. The inner bias device generates a second force biasing the inner valve head of the inner valve stem toward the inner valve seat of the outer valve stem. So configured, the inner valve stem occupies the open position and the outer valve stem occupies the closed position upon the application of a first pressure on the distal ends of the inner and outer valve stems, and the inner and outer valve stems occupy the open positions upon the application of a second pressure that is greater than the first pressure on the distal ends of the inner and outer valve stems.

Another aspect of the present disclosure provides a steam conditioning device including a steam pipe, and a plurality of spray nozzles connected to a manifold and mounted about the steam pipe. The plurality of spray nozzles being adapted to deliver cooling water flow into the steam pipe, wherein each spray nozzle includes a spray nozzle as described above and throughout the present specification.

In some aspects, the first force generated by the outer bias device is greater than the second force generated by the inner bias device.

In some aspects, the nozzle body comprises a cylindrical wall defining the first through bore.

In some aspects, the outer bias device is disposed at the proximal end of the outer valve stem and the inner bias device is disposed at the proximal end of the inner valve stem.

In some aspects, the outer bias device comprises a first nut attached to the proximal end of the outer valve stem and a first spring biasing against the first nut, and the inner bias device comprises a second nut attached to the proximal end of the inner valve stem and a second spring biased against the second nut.

In some aspects, the first spring is disposed around the proximal end of the outer valve stem and the second spring is disposed around the proximal end of the inner valve stem.

In some aspects, the proximal end of the nozzle body defines a shoulder surface, and when the outer valve stem is in the closed position the first nut is spaced away from the shoulder surface, and when the outer valve stem is in the open position the first nut is in contact with the shoulder surface.

In some aspects, when the inner valve stem is in the closed position the second nut is spaced away from the first nut, and when the inner valve stem is in the open position the second nut is in contact with the first nut.

In some aspects, the nozzle body, the outer valve stem, and the inner valve stem are coaxially aligned.

In some aspects, the inner and outer valve stems move in a common first direction from the closed positions to the open positions.

In some aspects, the spray nozzle further includes a nozzle casing attached to the nozzle body and enclosing the proximal end of at least one of (a) the inner valve stem and inner bias device, and (b) the outer valve stem and outer bias device.

In some aspects, the spray nozzle further includes a nozzle coupler having a proximal end, a distal end and a third through bore extending between the proximal and distal ends of the nozzle coupler, the nozzle coupler fixed in the second through bore of the outer valve steam, the third through bore slidably receiving the inner valve stem and defining the inner valve seat at the distal end of the nozzle coupler.

In some aspects, the second nut is coupled to the proximal end of the nozzle coupler and the second spring is disposed between the second nut and the nozzle coupler.

DETAILED DESCRIPTION

The present disclosure is directed to a spray nozzle typically for use in steam conditioning applications such as desuperheaters and steam conditioning valves, for example, but other applications are contemplated. In the disclosed embodiments, the spray nozzle includes two or more operating stages for accommodating an increased range of cooling fluid operating pressures and flow rates through the nozzle. The two or more stages are achieved through the implementation of two or more valve stems sensitive to different operating pressures.

Figure 1:
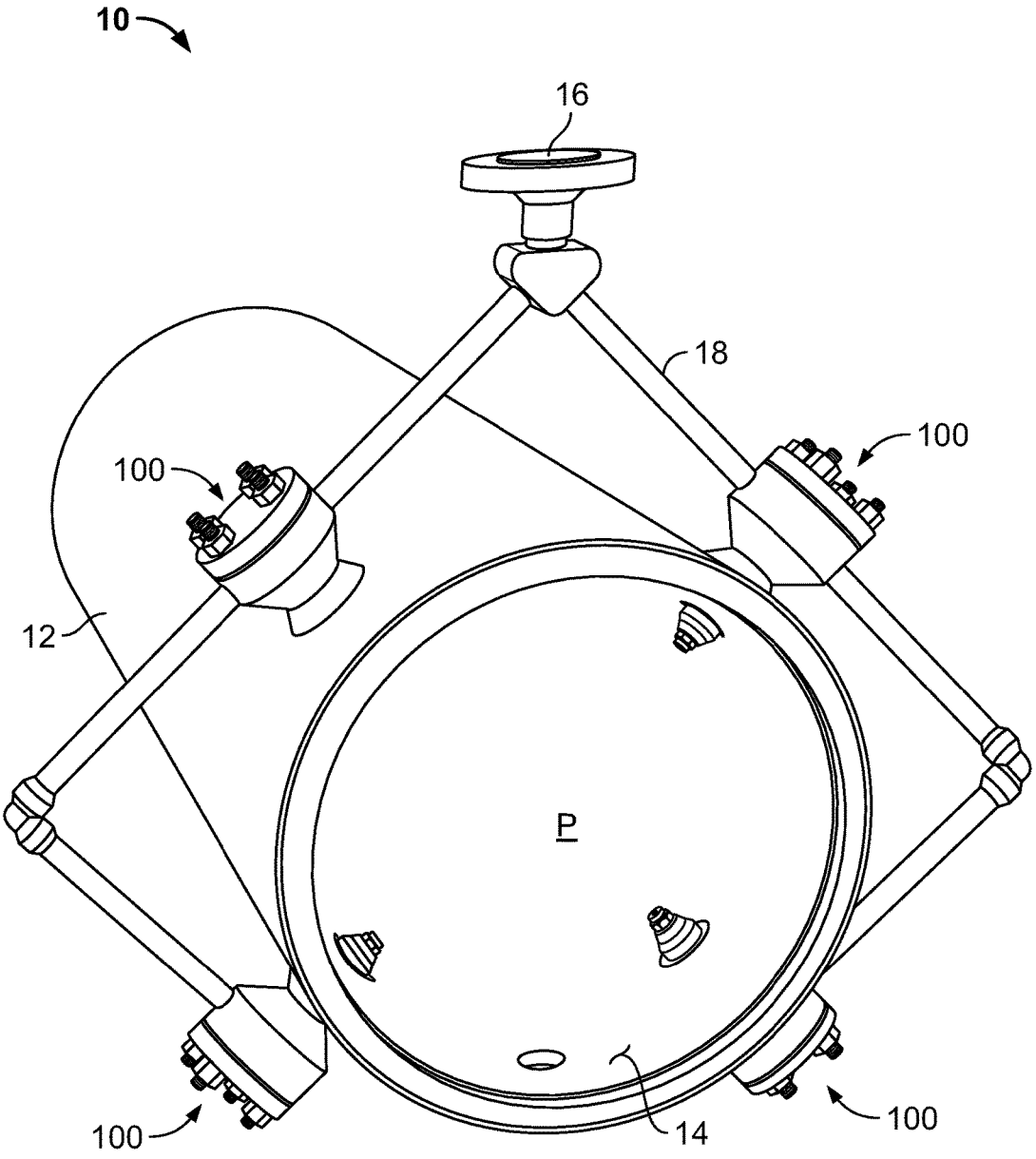
FIG. 1 is a perspective view of a steam pipe including a plurality of spray nozzles constructed in accordance with the teachings of the present disclosure.

FIG. 1 depicts a steam pipe 10 including a plurality of spray nozzles 100 constructed in accordance with the present disclosure. Generally, the steam pipe 10 can be used to reduce the temperature of superheated steam travelling therethrough to a desired set point temperature. By way of example only, the steam pipe 10 of FIG. 1 may be a portion of a desuperheater such as, for example, a Fisher® TBX-T desuperheater, a Fisher® DMA/AF desuperheater, or a Fisher® DMA/AF-HTC desuperheater. In other examples, the steam pipe 10 of FIG. 1 may be a portion of a steam conditioning valve such as, for example, a Fisher® TBX and CVX steam conditioning valve. The steam pipe 10 generally comprises a hollow cylindrical wall 12, which in some applications can include a thermal liner 14, defining a steam flow path P. Also, as shown, the steam pipe 10 includes the plurality of spray nozzles 100, each fed with cooling fluid by a spraywater manifold 18 having a fluid inlet 16. In the disclosed version, the steam pipe 10 includes four (4) spray nozzles 100 spaced approximately 90° apart about the cylindrical wall 12. Other configurations are intended to be within the scope of the present disclosure. As mentioned, the spray nozzles 100 of the present disclosure are constructed to have a large range of operating pressures and flow rates such that the same steam pipe 10 can be used in a variety of different applications, having different operating demands, without having to replace the spray nozzles 100.

During operation, superheated steam or gas may flow along the flow path P in the steam pipe 10 at high temperatures ranging, for example, from approximately 1000° F. to approximately 1200° F. Depending on the temperature, composition and flow rate of the working fluid, the amount of cooling fluid needed to reduce the temperature to the set point may vary. As such, the amount and pressure of cooling fluid passing through the spray nozzles 100 can vary for different applications and environments. For example, in certain circumstances, it may be necessary to have high pressure and high flow rates of cooling fluid passing through the spray nozzles 100, while in other circumstances low pressure and low flow rates are needed. The present disclosure advantageously provides a single spray nozzle that can work in both situations, serving a large range of operating conditions, while also providing a compact device with optimum useful life. Typical steam pressures range from very low pressures down to as low as approximately 5 psia (vacuum) up to perhaps 2500 psia or more. Cooling fluid pressures then are typically in the range of 50-500 psi greater than the steam pressure. Steam and water flow rates can vary even more widely depending on pipe size and pressure, as well as how much temperature reduction is desirable in the particular desuperheating application.

Figure 2:
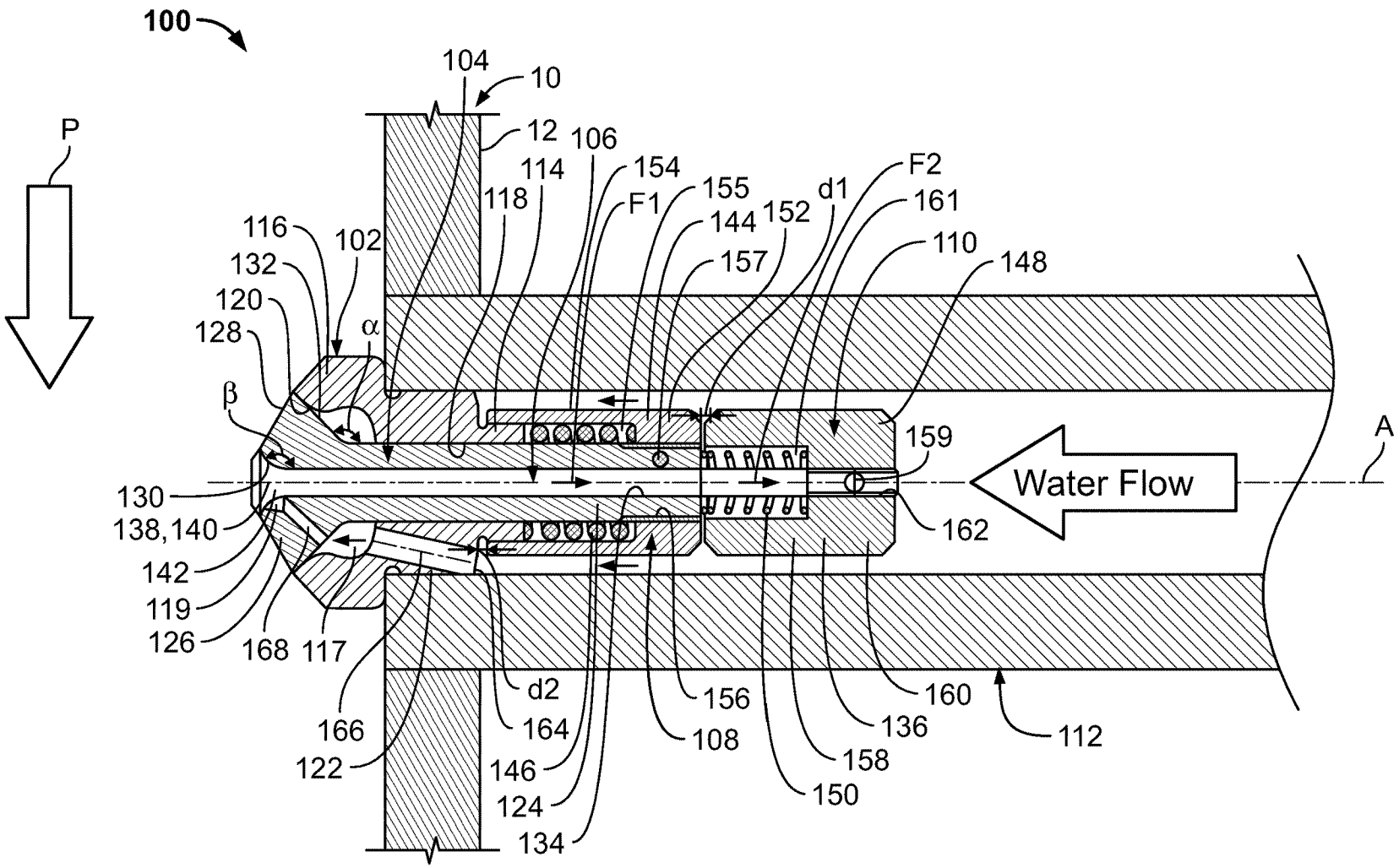
FIG. 2 is a cross-section of one version of a spray nozzle constructed in accordance with the teachings of the present disclosure, wherein the nozzle is shown in a fully closed stage.

FIG. 2 depicts a cross-section of one embodiment of the spray nozzles 100, mounted to the cylindrical wall 12 of the steam pipe 10 of FIG. 1. As illustrated, the nozzle 100 includes a nozzle body 102, an outer valve stem 104, an inner valve stem 106, an outer bias device 108, an inner bias device 110, and a nozzle casing 112. The nozzle casing 112 is illustrated as being mounted in an aperture or opening in the cylindrical wall 12 of the steam pipe 10. This mounting may be accomplished with a threaded connection, a weld, friction fit, adhesive, or any other means.

The nozzle body 102 is a hollow generally cylindrical body including a proximal end 114, a distal end 116, a through bore 118, and an outer valve seat 120. The through bore 118 extends between the proximal and distal ends 114, 116 and includes an enlarged flow cavity 117 at the distal end 116. The outer valve seat 120 is disposed at the distal end 116 and includes an inner annular surface of the nozzle body 102 surrounding the enlarged flow cavity 117. In one version, the outer valve seat 120 includes a frustoconical surface extending at an angle $\alpha$ relative to a longitudinal axis A of the spray nozzle 100. The nozzle body 102 further includes a threaded region 122 disposed between the proximal and distal ends 114, 116 and threadably attached to the nozzle casing 112. So configured, the nozzle body 102 is fixed against axial displacement relative to the nozzle casing 112. The proximal end 114 of the nozzle body 102 is disposed inside the nozzle casing 112 and outside of the steam pipe 10. The distal end 116 of the nozzle body 102 is disposed outside of the nozzle casing 112 and inside of the steam pipe 10. In the disclosed embodiment, the threaded region 122 has a diameter that is large than a diameter of the proximal end 114 of the nozzle boy 102 and smaller than a diameter of the distal end 116 of the nozzle body 102. While the present version of the spray nozzle 100 has been described as including the nozzle casing 112, in other versions, the nozzle casing 112 may be considered a component of the spraywater manifold 18 or cylindrical wall 112 of the steam pipe 10. For example, in some embodiments, the nozzle casing 112 may be an integral part of the steam pipe 10 such that the nozzle body is threaded directly into the steam pipe 10.

Figure 3:
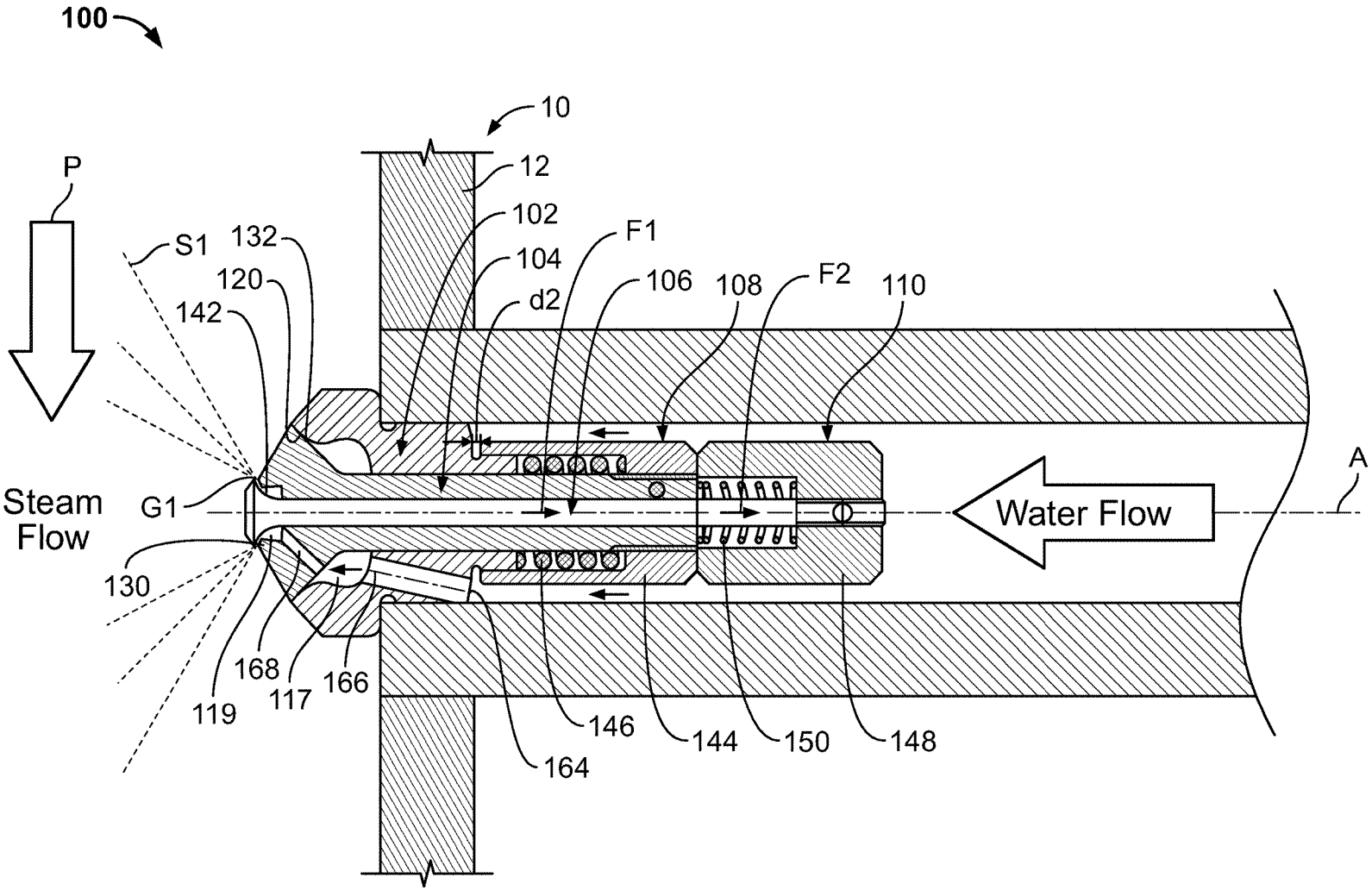
FIG. 3 is a cross-section of the spray nozzle of FIG. 2, wherein the nozzle is shown in a first open stage.
Figure 4:
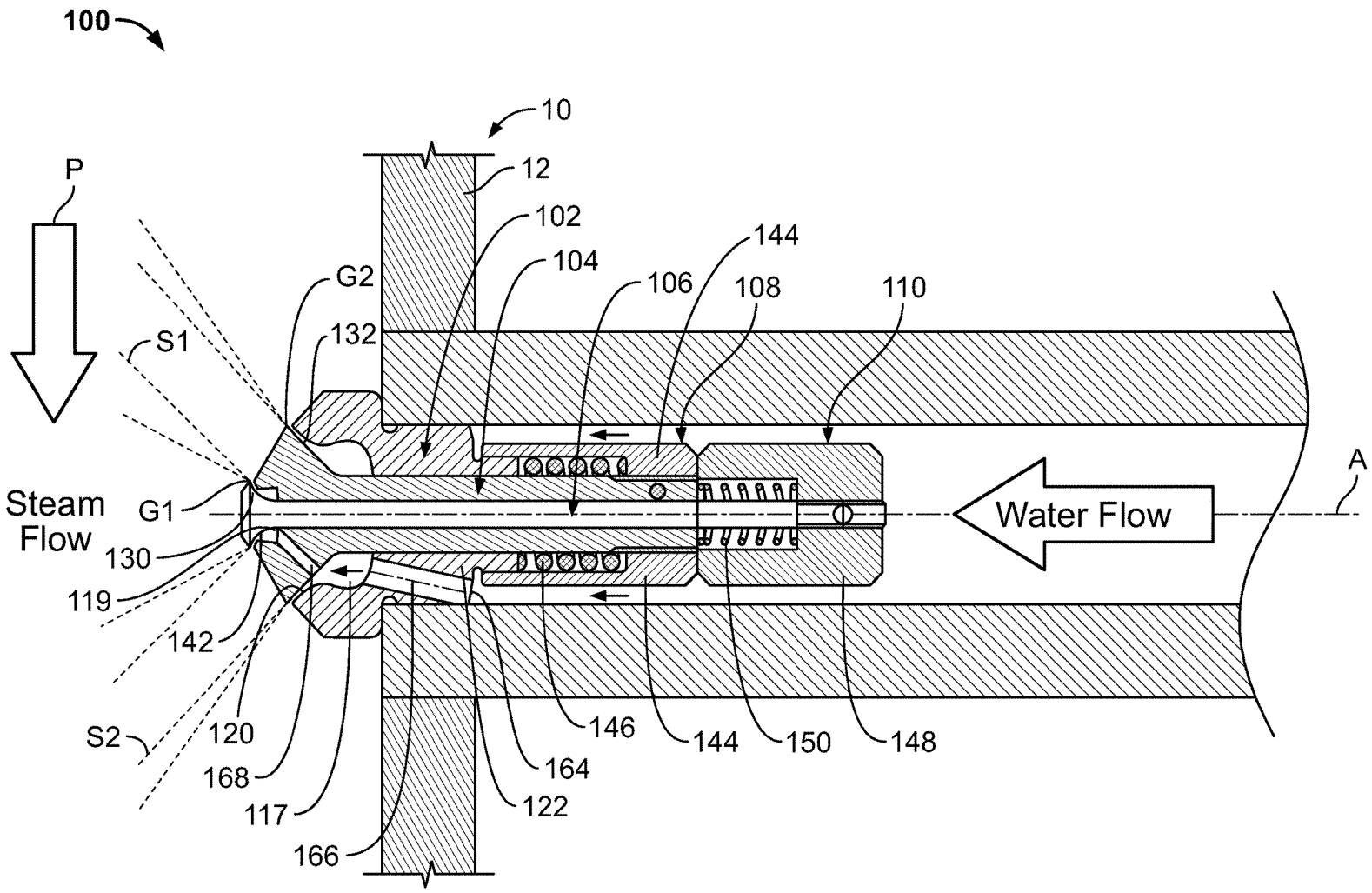
FIG. 4 is a cross-section of the spray nozzle of FIGS. 2 and 3, wherein the nozzle is shown in a second open stage.

Still referring to FIG. 2, the outer valve stem 104 is slidably disposed relative to the through bore 118 of the nozzle body 102 and includes an elongated member disposed on the longitudinal axis A. In this version, the outer valve stem 104 is slidably disposed in the through bore 118. As such, the outer valve stem 104 is coaxially aligned with the nozzle body 102. More specifically, the outer valve stem 104 includes a proximal end 124, a distal end 126, an outer valve head 128, a through bore 134, and an inner valve seat 130 carried by the outer valve head 128. The through bore 134 extends between the proximal and distal ends 124, 126 and defines an enlarged flow cavity 119 and the inner valve seat 130 at the distal end 126. The inner valve seat 130 includes an inner annular surface surrounding the enlarged flow cavity 119 of the through bore 134 in the outer valve stem 104. In one version, the inner valve seat 130 includes a frustoconical surface extending at an angle $\beta$ relative to the longitudinal axis A of the spray nozzle 100. The outer valve head 128 is disposed at the distal end 126 of the outer valve stem 104 and includes an enlarged portion defining a seating surface 132 for selectively seating against the outer valve seat 120 of the nozzle body 102. In some embodiments, to achieve a fluid tight seal, the seating surface 132 of the outer valve head 128 of the outer valve stem 104 can be disposed at the same angle α as the outer valve seat 120. Thus, the seating surface 132 of the outer valve head 128 is adapted to engage the outer valve seat 120 of the nozzle body 102 when the outer valve stem 104 is in a closed position (e.g., as shown in FIGS. 2 and 3) and is adapted to be spaced away from the outer valve seat 120 of the nozzle body 102 when the outer valve stem 104 is in an open position (e.g., as shown in FIG. 4).

The inner valve stem 106 is slidably disposed relative to the through bore 134 of the outer valve stem 104 and includes an elongated member disposed along the longitudinal axis A. In this version, the inner valve stem 106 is slidably disposed in the through bore 134. The inner valve stem 106 is coaxially aligned with the nozzle body 102 and the outer valve stem 104. More specifically, the inner valve stem 106 includes a proximal end 136, a distal end 138, and an inner valve head 140 disposed at the distal end 138. The inner valve head 140 includes an enlarged portion of the inner valve stem 106 that defines a seating surface 142 that can be a frustoconical surface disposed at the angle β relative to the longitudinal axis A of the spray nozzle 100. The seating surface 142 is therefore adapted to engage the inner valve seat 130 of the outer valve stem 104 when the inner valve stem 106 is in a closed position (e.g., as shown in FIG. 2) and adapted to be spaced away from the seating surface 142 of the inner valve seat 130 of the outer valve stem 104 when the inner valve stem 106 is in an open position (e.g., as shown in FIGS. 3 and 4).

As mentioned above, the spray nozzle 100 of the present disclosure further includes outer and inner bias devices 108, 110. In the disclosed embodiment, the outer and inner bias devices 108, 110 respectively bias the outer and inner valve stems 104, 106 into their closed positions. That is, the outer bias device 108 generates a first force F1 biasing the seating surface 132 of the outer valve head 128 of the outer valve stem 104 toward the outer valve seat 120 of the nozzle body 102. Similarly, the inner bias device 110 generates a second force F2 biasing the seating surface 142 of the inner valve head 140 of the inner valve stem 106 toward the inner valve seat 130 of the outer valve stem 104.

In the disclosed version of the spray nozzle 100, the outer and inner bias devices 108, 110 are located at the proximal ends 124, 136 of the respective outer and inner valve stems 104, 106. And, as such, the outer and inner bias devices 108, 110 are located inside of the nozzle casing 112 of the version of the spray nozzle 100 depicted in FIGS. 2-4. So configured, during use the outer and inner bias devices 108, 110 are only exposed to the cooling fluid flowing through the spray nozzle 100, which in the disclosed version is via the nozzle casing 112 and spraywater manifold 18. This advantageously maintains the outer and inner bias devices 108, 110 at a temperature consistent with the cooling fluid which is within the normal operating range for the materials used. This advantageously optimizes the useful life of the bias devices 108, 110 because exposure to high temperatures, such as those inside of the steam pipe 10, can degrade the integrity of the components of the bias devices 108, 110.

With more specific reference to FIG. 2, the disclosed version of the outer bias device 108 includes a first nut 144 and a first spring 146, while the inner bias device 110 includes a second nut 148 and a second spring 150. The first spring 146 can be disposed about or around the proximal end 124 of the outer valve stem 104 and the second spring 150 can be disposed about or around the proximal end 136 of the inner valve stem 106.

The first nut 144 is a hollow tubular member including a collar portion 154 and a shoulder portion 152 having threads 156 threadably coupled to the proximal end 124 of the outer valve stem 104. Additionally, the depicted version of the outer bias device 108 further includes a stop pin 157 extending through and coupling the first nut 144 to the proximal end 124 of the outer valve stem 104. The stop pin 157 can therefore prevent relative rotation of the first nut 144 and the outer valve stem 104, which can change the axial location of the first nut 144. The collar portion 154 defines an annular recess 155 in which the first spring 146 resides at a location compressed between the proximal end 114 of the nozzle body 102 and the shoulder portion 152 of the first nut 144. Thus, in the depicted version, the compressed first spring 146 exerts the first force F1 by bearing against the fixed nozzle body 102 to push the first nut 144 and therefore the outer valve stem 104 that is fixed to the first nut 144 away from the nozzle body 102.

The second nut 148 of the second bias device 110 is also a hollow tubular member including a collar portion 158 and a shoulder portion 160 having threads 162 threadably coupled to the proximal end 136 of the inner valve stem 106. Additionally, the depicted version of the inner bias device 110 further includes a stop pin 159 extending through and coupling the second nut 148 to the proximal end 136 of the inner valve stem 106. The stop pin 159 can therefore prevent relative rotation of the second nut 148 and the inner valve stem 106, which can change the axial location of the second nut 148. The collar portion 158 defines an annular recess 161 in which the second spring 150 resides at a location compressed between the proximal end 124 of the outer valve stem 104 and the shoulder portion 160 of the second nut 148. Thus, in the depicted version, the compressed second spring 150 exerts the second force F2 by bearing against the proximal end 124 of the outer valve stem 104 to push the second nut 148 and therefore the inner valve stem 106 that is fixed to the second nut 148 away from the outer valve stem 104 and the nozzle body 102.

In the disclosed embodiment, the first force F1 generated by the outer bias device 108 is greater than the second force F2 generated by the inner bias device 110. As such, the second spring 150 of the second bias device 110 can push the second nut 148 and inner valve stem 106 away from the outer valve stem 104 and nozzle body 102 without pushing the seating surface 132 of the outer valve stem 104 out of engagement with the outer valve seat 120 of the nozzle body 102. Moreover, this relationship of relative forces between the first and second springs 146, 150 facilitates the intended two-stage operation of the disclosed spray nozzle 100.

During operation, the spray nozzle 100 disclosed herein has one closed state and two operating states or stages. FIG. 2, discussed above, depicts the closed state wherein the seating surface 132 of the outer valve stem 104 is sealingly engaged against the outer valve seat 120 of the nozzle body 102 by way of the first force F1 generated by the outer bias device 108. And, in FIG. 2, the seating surface 142 of the inner valve stem 106 is sealingly engaged against the inner valve seat 130 of the outer valve stem 104 by way of the second force F2 generated by the inner bias device 110. In this configuration, the cooling fluid cannot pass through the spray nozzle 100.

During a first stage of operation, however, cooling fluid of a first pressure and flow rate can be supplied to the spray nozzle 100 by way of the nozzle casing 112 and, more particularly, applied to the distal ends 124, 136 of the outer and inner valve stems 104, 106. The cooling water is ultimately supplied to the enlarged flow cavity 117 in the nozzle body 102 by way of a flow conduit 166 in the nozzle body 102, and to the enlarged flow cavity 119 of the outer valve stem 104 by way of a flow conduit 168 in the outer valve stem 104. Thus, fluid pressure in the flow cavity 117 of the nozzle body 102 is applied to the exposed backside of the seating surface 132 of the outer valve stem 104, and pressure in the flow cavity 119 is applied to the exposed backside of the seating surface 142 of the inner valve stem 106. These applied pressures work against the biases of the first and second springs 146, 150.

In one embodiment, a first pressure is sufficient to overcome the second force F2 to move the inner valve stem 106 toward the nozzle body 102 such that the seating surface 142 moves to be spaced away from the inner valve seat 130 on the outer valve stem 104. In this position, as depicted in FIG. 3, a first cone of spray S1 is emitted from the spray nozzle 100 and, more particularly, from a first gap G1 positioned between the seating surface 142 of the inner valve stem 106 and the inner valve seat 130. Before the fluid pressure overcomes the second force F2, the second nut 148 of the inner bias device 110 attached to the inner valve stem 106 is spaced away a distance d1 (shown in FIG. 2) from the first nut 144 of the outer bias device 108. But, as the fluid pressure overcomes the second force F2, the second nut 148 contacts the first nut 144, as depicted in FIG. 3. In this configuration, the first nut 144 acts as a stop to limit movement of the inner valve stem 106 and position the inner valve stem 106 in an open position, while the outer valve stem 104 continues to maintain its closed position because the first pressure is insufficient to overcome the first force F1.

As the pressure of the supplied cooling water is increased, it can also overcome the first force F1 such that the spray nozzle 100 operates in a second stage. In the second stage, a second fluid pressure greater than the first moves the outer valve stem 104 in the same direction as the inner valve stem 106 toward the nozzle body 102 such that the seating surface 132 moves to be spaced a second distance d2 (shown in FIGS. 2 and 3) away from the outer valve seat 120 on the nozzle body 102. In this configuration, as shown in FIG. 4, the inner and outer valve stems 106, 104 occupy open positions. More particularly, the first nut 144 attached to the outer valve stem 104 moves from a position spaced away from a shoulder surface 164 on the proximal end 122 of the nozzle body 102, to a position in contact with the shoulder surface 164. As such, the shoulder surface 164 limits movement of the first nut 144 and outer valve stem 104. Thus, in FIG. 4, a second cone of spray S2 accompanies the first cone or spray S1 emitted from the spray nozzle 100 due to the presence of a second gap G2 between the seating surface 132 of the outer valve stem 104 and the outer valve seat 120 of the nozzle body 102.

Figure 5:
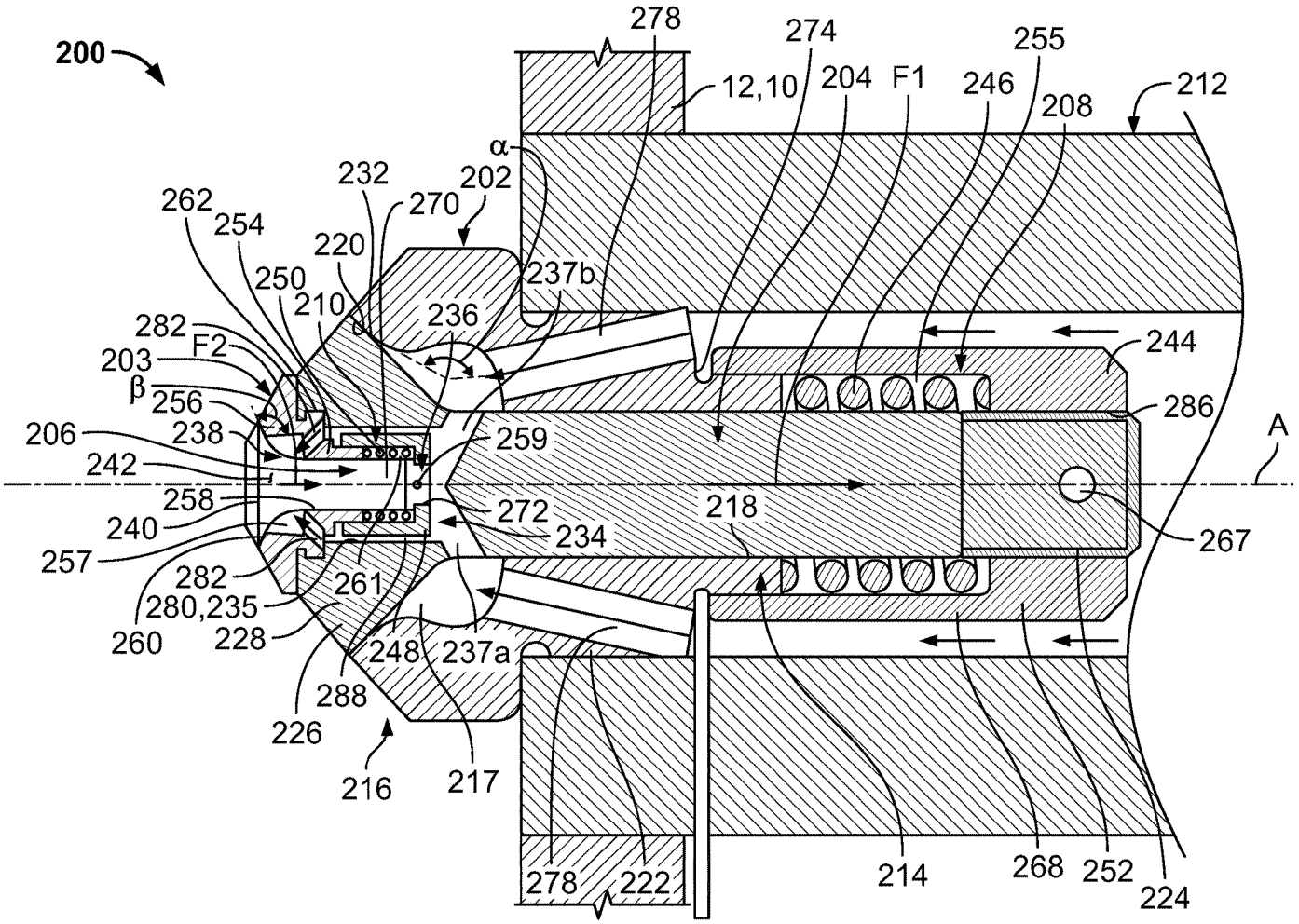
FIG. 5 is a cross-section of another version of a spray nozzle constructed in accordance with the principles of the present disclosure, wherein the nozzle is shown in a fully closed stage.

FIG. 5 depicts a cross-section of an alternative spray nozzle 200, which could be interchanged with the spray nozzles 100 described above in FIGS. 1-4. As illustrated, the nozzle 200 includes a nozzle body 202, an outer valve stem 204, an inner valve stem 206, an outer bias device 208, an inner bias device 210, and a nozzle casing 212. Additionally, as will be described in more detail below, the spray nozzle 200 includes a nozzle coupler 203 supporting the inner valve stem 206 and inner bias device 210. The nozzle casing 212 is illustrated as being mounted in an aperture or opening in the cylindrical wall 12 of the steam pipe 10 in a manner identical to the spray nozzles 100 in FIG. 1. This mounting may be accomplished with a threaded connection, a weld, friction fit, adhesive, or any other means.

As with the nozzle 100 described above in FIGS. 2-4, the nozzle body 202 in FIG. 5 is a hollow generally cylindrical body including a proximal end 214, a distal end 216, a through bore 218, and an outer valve seat 220. The through bore 218 extends between the proximal and distal ends 214, 216 and includes an enlarged flow cavity 217 at the distal end 216. The outer valve seat 220 is disposed at the distal end 216 and includes an inner annular surface of the nozzle body 202 surrounding the enlarged flow cavity 217. In one version, the outer valve seat 220 includes a frustoconical surface at least a portion of which extends at an angle $\alpha$ relative to a longitudinal axis A of the spray nozzle 100. The nozzle body 202 further includes a threaded region 222 disposed between the proximal and distal ends 214, 216 and threadably attached to the nozzle casing 212. So configured, the nozzle body 202 is fixed against axial displacement relative to the nozzle casing 212. The proximal end 214 of the nozzle body 202 is disposed inside the nozzle casing 212 and outside of the steam pipe 10. The distal end 216 of the nozzle body 202 is disposed outside of the nozzle casing 212 and inside of the steam pipe 10. In the disclosed embodiment, the threaded region 222 has a diameter that is large than a diameter of the proximal end 214 of the nozzle body 202 and smaller than a diameter of the distal end 216 of the nozzle body 202. While the present version of the spray nozzle 200 has been described as including the nozzle casing 212, in other versions, the nozzle casing 212 may be considered a component of the spraywater manifold 18 or cylindrical wall 12 of the steam pipe 10. For example, in some embodiments, the nozzle casing 12 may be an integral part of the steam pipe 10 such that the nozzle body is threaded directly into the steam pipe 10.

Still referring to FIG. 5, the outer valve stem 204 is slidably disposed relative to and in the through bore 218 of the nozzle body 202 and includes an elongated member disposed on the longitudinal axis A. As such, the outer valve stem 204 is coaxially aligned with the nozzle body 202. The outer valve stem 204 includes a proximal end 224, a distal end 226, an outer valve head 228, and a through bore 234. In the depicted version, the through bore 234 in the outer valve stem 204 extends from the distal end 226 toward the proximal end 224 but not entirely through the proximal end 224. Instead, the through bore 234 includes a retention portion 235 adjacent the distal end 226 and at least a pair of conduit portions 237*a*, 237*b* on the opposite end extending radially at an angle out of a side wall of the outer valve stem 204. So configured, fluid passing through the spray nozzle 200 can reach the inner valve stem 206, as will be described below. In other versions, the through bore 234 in the outer valve stem 204 may extend entirely through the outer valve stem 204 from the distal end 226 to the proximal end 224, similar to the configuration of the outer valve stem in FIGS. 2-4.

Continuing to refer to FIG. 5, the outer valve head 228 is disposed at the distal end 226 of the outer valve stem 204 and includes an enlarged portion defining a seating surface 232 for selectively seating against the outer valve seat 220 of the nozzle body 202. In some embodiments, to achieve a fluid tight seal, the seating surface 232 of the outer valve head 228 of the outer valve stem 204 can be disposed at the same angle $\alpha$ as the outer valve seat 220. Thus, the seating surface 232 of the outer valve head 228 is adapted to engage the outer valve seat 220 of the nozzle body 202 when the outer valve stem 204 is in a closed position (e.g., as shown in FIG. 5) and is adapted to be spaced away from the outer valve seat 220 of the nozzle body 202 when the outer valve stem 204 is in an open position (not shown).

The inner valve stem 206 of the version of the spray nozzle 200 depicted in FIG. 5 is distinct from the version of FIGS. 2-4 in that the inner valve stem 206 is carried within the nozzle coupler 203, which in turn is fixedly mounted in the retention portion 235 of the through bore 234 of the outer valve stem 204. That is, the nozzle coupler 203 is a hollow generally cylindrical body, similar in geometry to the nozzle body 202, including a proximal end 254, a distal end 256, a through bore 258, and an inner valve seat 260. The through bore 258 extends between the proximal and distal ends 254, 256 and includes an enlarged flow cavity 257 at the distal end 256. The inner valve seat 260 is disposed at the distal end 256 and includes an inner annular surface of the nozzle coupler 203 surrounding the enlarged flow cavity 257. In one version, the inner valve seat 260 includes a frustoconical surface at least a portion of which extends at an angle β relative to a longitudinal axis A of the spray nozzle 200. The nozzle coupler 203 further includes a threaded region 262 disposed between the proximal and distal ends 254, 256 and threadably attached inside of the retention portion 235 of the through bore 234 in the outer valve stem 204. So configured, the nozzle coupler 203 is fixed against axial displacement relative to the outer valve stem 204. The proximal end 254 of the nozzle coupler 203 is disposed inside the outer valve stem 204. The distal end 256 of the nozzle coupler 203 is disposed outside of the outer valve stem 204 and inside of the steam pipe 10. In the disclosed embodiment, the threaded region 262 has a diameter that is large than a diameter of the proximal end 254 of the nozzle coupler 203 and smaller than a diameter of the distal end 256 of the nozzle coupler 203.

As shown in FIG. 5, the inner valve stem 206 is slidably disposed relative to and in the through bore 258 of the nozzle coupler 203 and includes an elongated member disposed along the longitudinal axis A. As such, the inner valve stem 206 is coaxially aligned with the nozzle coupler 203, the nozzle body 202 and the outer valve stem 204. The inner valve stem 206 includes a proximal end 236, a distal end 238, and an inner valve head 240 disposed at the distal end 238. The inner valve head 240 includes an enlarged portion of the inner valve stem 206 that defines a seating surface 242 that can be a frustoconical surface disposed at the angle β relative to the longitudinal axis A of the spray nozzle 200. The seating surface 242 is therefore adapted to engage the inner valve seat 260 of the nozzle coupler 203 when the inner valve stem 206 is in a closed position (e.g., as shown in FIG. 5) and is adapted to be spaced away from the inner valve seat 260 of the nozzle coupler 203 when the inner valve stem 206 is in an open position (not shown).

As mentioned above, the spray nozzle 200 of the present disclosure further includes outer and inner bias devices 208, 210. In the disclosed embodiment, the outer and inner bias devices 208, 210 respectively bias the outer and inner valve stems 204, 206 into their closed positions. That is, the outer bias device 208 generates a first force F1 biasing the seating surface 232 of the outer valve head 228 of the outer valve stem 204 toward the outer valve seat 220 of the nozzle body 202. Similarly, the inner bias device 210 generates a second force F2 biasing the seating surface 242 of the inner valve stem 206 toward the inner valve seat 260 of the nozzle coupler 203.

In the version of the spray nozzle 200 in FIG. 5, the outer and inner bias devices 208, 210 are located at the proximal ends 224, 236 of the respective outer and inner valve stems 204, 206. The outer bias device 208 is located inside of the nozzle casing 212, and the inner bias device 210 is located inside of the outer valve head 228 of the outer valve stem 204. So configured, as with the prior version of the spray nozzle 100 disclosed with reference to FIGS. 2-4, during use the outer and inner bias devices 208, 210 are only exposed to the cooling fluid flowing through the spray nozzle 200, which in the disclosed version is via the nozzle casing 212 and spraywater manifold 18. This advantageously maintains the outer and inner bias devices 208, 210 at a temperature consistent with the cooling fluid which is within the normal operating range for the materials used. This advantageously optimizes the useful life of the bias devices 208, 210 because exposure to high temperatures, such as those inside of the steam pipe 10, can degrade the integrity of the components of the bias devices 208, 210.

In more detail, the disclosed version of the outer bias device 208 includes a first nut 244 and a first spring 246, while the inner bias device 210 includes a second nut 248 and a second spring 250. The first spring 246 can be disposed about or around the proximal end 224 of the outer valve stem 204 and the second spring 250 can be disposed about or around the proximal end 236 of the inner valve stem 206.

The first nut 244 is a hollow tubular member including a collar portion 268 and a shoulder portion 252 having threads 286 threadably coupled to the proximal end 224 of the outer valve stem 204. Additionally, the depicted version of the outer bias device 208 further includes a stop pin 267 extending through and coupling the first nut 244 to the proximal end 224 of the outer valve stem 204. The stop pin 267 can therefore prevent relative rotation of the first nut 244 and the outer valve stem 204, which can change the axial location of the first nut 244. The collar portion 268 defines an annular recess 255 in which the first spring 246 resides at a location compressed between the proximal end 214 of the nozzle body 202 and the shoulder portion 252 of the first nut 244. Thus, in the depicted version, the compressed first spring 246 exerts the first force F1 by bearing against the fixed nozzle body 202 to push the first nut 244 away from the nozzle body 202, thereby seating the seating surface 232 on the outer valve stem 204 against the valve seat 220 on the nozzle body 202.

The second nut 248 of the second bias device 210 is also a hollow tubular member including a collar portion 288 and a shoulder portion 270 having threads 272 threadably coupled to the proximal end 236 of the inner valve stem 206. Additionally, the depicted version of the inner bias device 210 further includes a stop pin 259 extending through and coupling the second nut 248 to the proximal end 236 of the inner valve stem 206. The stop pin 259 can therefore prevent relative rotation of the second nut 248 and the inner valve stem 206, which can change the axial location of the second nut 248. The collar portion 288 defines an annular recess 261 in which the second spring 250 resides at a location compressed between the proximal end 254 of the nozzle coupler 203 and the shoulder portion 270 of the second nut 248. Thus, in the depicted version, the compressed second spring 250 exerts the second force F2 by bearing against the proximal end 254 of the nozzle coupler 203 to push the second nut 248 away from the nozzle coupler 203, thereby seating the seating surface 242 of the inner valve stem 206 against the inner valve seat 260.

In the embodiment in FIG. 5, like that in FIGS. 2-4, the first force F1 generated by the outer bias device 208 is greater than the second force F2 generated by the inner bias device 210. This relationship of relative forces between the first and second springs 246, 250 facilitates the intended two-stage operation of the disclosed spray nozzle 200.

During operation, the spray nozzle 200 has one closed state or stage and two operating states or stages. FIG. 5, discussed above, depicts the closed state wherein the seating surface 232 of the outer valve stem 204 is sealingly engaged against the outer valve seat 220 of the nozzle body 202 by way of the first force F1 generated by the outer bias device 208. The seating surface 242 of the inner valve stem 206 is sealingly engaged against the inner valve seat 260 of the nozzle coupler 203 by way of the second force F2 generated by the inner bias device 210. In this configuration, the cooling fluid cannot pass through the spray nozzle 200.

During a first stage of operation, however, cooling fluid of a first pressure and flow rate can be supplied to the spray nozzle 200 by way of the nozzle casing 212 and, more particularly, applied to the distal ends 224, 236 of the outer and inner valve stems 204, 206. The cooling water is supplied to the enlarged flow cavity 217 in the nozzle body 202 by way of at least a pair of flow conduits 278 extending axially through the nozzle body 202. Cooling water is further supplied to the enlarged flow cavity 257 in the nozzle coupler 203 via the conduit portions 237*a*, 237*b* and retention portion 235 of the through bore 234 of the outer valve stem 204. More specifically, as can be seen in FIG. 5, a diameter of the second nut 248 of the inner bias device 210 is smaller than a diameter of the retention portion 235 of the through bore 234 in the outer valve stem 204, resulting in an annular gap 280 surrounding the second nut 248. As such, cooling water passes through the annular gap 280, and then through at least a pair of flow conduits 282 extending through the nozzle coupler 203 and into the enlarged flow cavity 257 at the backside of the valve head 240 of the inner valve stem 206.

Thus, fluid pressure in the flow cavity 217 of the nozzle body 202 is applied to the exposed backside of the seating surface 232 of the outer valve stem 204, and pressure in the flow cavity 257 is applied to the exposed backside of the seating surface 242 of the inner valve stem 206. These applied pressures work against the biases of the first and second springs 246, 250.

In one embodiment, a first pressure is sufficient to overcome the second force F2 to move the inner valve stem 206 such that the seating surface 242 moves to be spaced away from the inner valve seat 260 on the nozzle coupler 203. In this position, a first cone of spray (not shown) is emitted from the spray nozzle 200 from a location between the inner valve stem 206 and the nozzle coupler 203. Before the fluid pressure overcomes the second force F2, the second nut 248 of the inner bias device 210 attached to the inner valve stem 206 is spaced away a distance from the proximal end 254 of the nozzle coupler 203, as shown in FIG. 5. But, as the fluid pressure overcomes the second force F2, the spring 250 compresses such that the second nut 248 contacts the proximal end 254 of the nozzle coupler 203 (not shown). The nozzle coupler 203 acts as a stop to limit movement of the inner valve stem 206 and position the inner valve stem 206 in an open position, while the outer valve stem 204 continues to maintain its closed position because the first pressure is insufficient to overcome the first force F1.

As the pressure of the supplied cooling water is increased, it can also overcome the first force F1 such that the spray nozzle 200 operates in a second stage. In the second stage, a second fluid pressure greater than the first also moves the outer valve stem 204 in the same direction as the inner valve stem 206 such that the seating surface 232 on the outer valve head 228 moves to be spaced (not shown) away from the outer valve seat 220 on the nozzle body 202. In this configuration, the inner and outer valve stems 206, 204 occupy open positions. More particularly, the first nut 244 attached to the outer valve stem 204 moves from a position spaced away from a shoulder surface 274 on the proximal end 214 of the nozzle body 202 (shown in FIG. 5), to a position in contact with the shoulder surface 274 (not shown). As such, the shoulder surface 274 limits movement of the first nut 244 and outer valve stem 204. Thus, a second cone of spray (not shown) emits from a location between the outer valve stem 204 and the nozzle body 202 and accompanies the first cone of spray (not shown) emitting from a location between the inner valve stem 206 and the nozzle coupler 203.

Based on the foregoing, the present disclosure provides a spray nozzle that can operate in a first open stage at low pressures and high flow rates, and operate at a second stage at high pressures and high flow rates, which advantageously increase the total range of pressures and flow rates over known spray nozzles in similar applications. Moreover, the present disclosure provides a very simple and compact design with an optimal useful life. That is, because the various valve stem bias devices are located only in the cooling fluid flow path, they are not exposed to the superheated temperatures resident in the steam pipe which can degrade and weaken the bias device components. Furthermore, in some embodiments, the bias devices are of very simple construction, consisting only of nuts and springs attached to the proximal ends of the valve stems. This minimum number of components allows the overall axial and radial dimension of the spray nozzle to be minimized which facilitates handling, reduces material costs, and reduces the overall size of the steam pipe or other steam conditioning device to which the nozzles are attached.

While the foregoing description includes spray nozzles 100, 200 having two stage of operation—one with a single cone of spray and one with dual cones of spray—alternative forms of spray nozzles within the scope of the present disclosure may have three, four, or even more stages. In order to add stages, a person of ordinary skill would understand that additional valve stems could be nested inside of the inner valve stem 106, 206 of the disclosed spray nozzles 100, 200 but the same principles of operation would apply with each stage including a bias device generating slightly more force than the immediately prior bias device.

As mentioned above in relation to FIG. 1, a steam pipe 10 constructed in accordance with the present disclosure can include a plurality of spray nozzles 100, 200. In one embodiment, each of the spray nozzles 100, 200 attached to the cylindrical wall 12 can be the same, e.g., having the same size valve stems and/or bias devices. But in other embodiments, one or more of the spray nozzles 100, 200 may be sized differently than others in order to achieve different spray patterns into the steam pipe 10. Moreover, while the steam pipe 10 in FIG. 1 includes four (4) nozzles, other versions may have more or less.

Finally, based on the foregoing it should be appreciated that the scope of the present disclosure is not limited to the specific examples disclosed herein and a variety of changes and modifications can be useful depending on a desired end application and such changes and modifications are intended to be within the scope of the disclosure. Accordingly, the scope of the invention is not to be defined by the examples discussed herein and shown in the attached figures, but rather, the claims that are ultimately issued in a patent and all equivalents thereof.

What is claimed:

1. A spray nozzle, comprising:

a nozzle body having a proximal end, a distal end, a first through bore extending between the proximal and distal ends of the nozzle body, and an outer valve seat disposed at the distal end of the nozzle body;

an outer valve stem slidably disposed relative to the first through bore of the nozzle body and including a proximal end, a distal end, and an outer valve head, the outer valve head carrying an inner valve seat at the distal end of the outer valve stem, and a second through bore extending through at least a distal portion of the outer valve stem, the outer valve head adapted to engage the outer valve seat of the nozzle body when the outer valve stem is in a closed position and adapted to be spaced away from the outer valve seat of the nozzle body when the outer valve stem is in an open position;

an inner valve stem slidably disposed relative to the second through bore of the outer valve stem and including a proximal end, a distal end, and an inner valve head disposed at the distal end of the inner valve stem, the inner valve head adapted to engage the inner valve seat when the inner valve stem is in a closed position and adapted to be spaced away from the inner valve seat when the inner valve stem is in an open position;

an outer bias device generating a first force biasing the outer valve head of the outer valve stem toward the outer valve seat of the nozzle body;

an inner bias device generating a second force biasing the inner valve head of the inner valve stem toward the inner valve seat of the outer valve stem; and a nozzle coupler having a proximal end, a distal end, and a third through bore extending between the proximal and distal ends of the nozzle coupler, the nozzle coupler being fixed in the second through bore of the outer valve stem;

wherein the inner valve stem occupies the open position and the outer valve stem occupies the closed position upon the application of a first pressure on the distal ends of the inner and outer valve stems, and the inner and outer valve stems occupy the open positions upon the application of a second pressure that is greater than the first pressure on the distal ends of the inner and outer valve stems.

2. The spray nozzle of claim 1, wherein the first force generated by the outer bias device is greater than the second force generated by the inner bias device.

3. The spray nozzle of claim 1, wherein the nozzle body comprises a cylindrical wall defining the first through bore.

4. The spray nozzle of claim 1, wherein the outer bias device is disposed at the proximal end of the outer valve stem and the inner bias device is disposed at the proximal end of the inner valve stem.

5. The spray nozzle of claim 1, wherein the nozzle body, the outer valve stem, and the inner valve stem are coaxially aligned.

6. The spray nozzle of claim 1, wherein the inner and outer valve stems move in a common first direction from the closed positions to the open positions.

7. The spray nozzle of claim 1, further comprising a nozzle casing attached to the nozzle body and enclosing the proximal end of at least one of (a) the inner valve stem and inner bias device, and (b) the outer valve stem and outer bias device.

8. The spray nozzle of claim 1, wherein the third through bore of the nozzle coupler slidably receiving the inner valve stem and defining the inner valve seat at the distal end of the nozzle coupler.

9. The spray nozzle of claim 8, wherein the second nut is coupled to the proximal end of the nozzle coupler and the second spring is disposed between the second nut and the nozzle coupler.

10. The spray nozzle of claim 1, wherein the outer bias device comprises a first nut attached to the proximal end of the outer valve stem and a first spring biasing against the first nut, and the inner bias device comprises a second nut attached to the proximal end of the inner valve stem and a second spring biased against the second nut.

11. The spray nozzle of claim 10, wherein the first spring is disposed around the proximal end of the outer valve stem and the second spring is disposed around the proximal end of the inner valve stem.

12. The spray nozzle of claim 10, wherein the proximal end of the nozzle body defines a shoulder surface, and when the outer valve stem is in the closed position the first nut is spaced away from the shoulder surface, and when the outer valve stem is in the open position the first nut is in contact with the shoulder surface.

13. The spray nozzle of claim 10, wherein when the inner valve stem is in the closed position the second nut is spaced away from the first nut, and when the inner valve stem is in the open position the second nut is in contact with the first nut.

14. A steam conditioning device, comprising:

a steam pipe;

a plurality of spray nozzles connected to a manifold and mounted about the steam pipe, the plurality of spray nozzles adapted to deliver cooling water flow into the steam pipe, each spray nozzle comprising:

a nozzle body having a proximal end disposed outside the steam pipe and connected to the manifold, a distal end disposed inside the steam pipe for delivering cooling water flow, a first through bore extending between the proximal and distal ends of the nozzle body, and an outer valve seat disposed at the distal end of the nozzle body;

an outer valve stem slidably disposed relative to the first through bore of the nozzle body and including a proximal end, a distal end, and an outer valve head, the outer valve head carrying an inner valve seat at the distal end of the outer valve stem, and a second through bore extending through at least a distal end portion of the outer valve stem, the outer valve head adapted to engage the outer valve seat of the nozzle body when the outer valve stem is in a closed position and adapted to be spaced away from the outer valve seat of the nozzle body when the outer valve stem is in an open position;

an inner valve stem slidably disposed relative to the second through bore of the outer valve stem and including a proximal end, a distal end, and an inner valve head disposed at the distal end of the inner valve stem, the inner valve head adapted to engage the inner valve seat when the inner valve stem is in a closed position and adapted to be spaced away from the inner valve seat when the inner valve stem is in an open position;

an outer bias device generating a first force biasing the outer valve head of the outer valve stem toward the outer valve seat of the nozzle body;

an inner bias device generating a second force biasing the inner valve head of the inner valve stem toward the inner valve seat of the outer valve stem; and a nozzle coupler having a proximal end, a distal end, and a third through bore extending between the proximal and distal ends of the nozzle coupler, the nozzle coupler being fixed in the second through bore of the outer valve stem;

wherein the inner valve stem occupies the open position and the outer valve stem occupies the closed position upon the application of a first pressure on the distal ends of the inner and outer valve stems, and the inner and outer valve stems occupy the open positions upon the application of a second pressure that is greater than the first pressure on the distal ends of the inner and outer valve stems.

15. The steam conditioning device of claim 14, wherein the first force generated by the outer bias device is greater than the second force generated by the inner bias device.

16. The steam conditioning device of claim 14, wherein the nozzle body comprises a cylindrical wall defining the first through bore.

17. The steam conditioning device of claim 14, wherein the outer bias device is disposed outside of the steam pipe at the proximal end of the outer valve stem and the inner bias device is disposed outside the steam pipe at the proximal end of the inner valve stem.

18. The steam conditioning device of claim 14, wherein the first spring is disposed around the proximal end of the outer valve stem and the second spring is disposed around the proximal end of the inner valve stem.

19. The steam conditioning device of claim 14, wherein the nozzle body, the outer valve stem, and the inner valve stem are coaxially aligned.

20. The steam conditioning device of claim 14, wherein the inner and outer valve stems move in a common first direction from the closed positions to the open positions.

21. The steam conditioning device of claim 14, further comprising a nozzle casing attached to the nozzle body, the nozzle casing enclosing the inner and outer bias devices.

22. The steam conditioning device of claim 14, wherein the third through of the nozzle coupler bore slidably receiving the inner valve stem and defining the inner valve seat at the distal end of the nozzle coupler.

23. The steam conditioning device of claim 22, wherein the second nut is coupled to the proximal end of the nozzle coupler and the second spring is disposed between the second nut and the nozzle coupler.

24. The steam conditioning device of claim 14, wherein the outer bias device comprises a first nut attached to the proximal end of the outer valve stem and a first spring biased against the first nut, and the inner bias device comprises a second nut attached to the proximal end of the inner valve stem and a second spring biased against the second nut.

25. The steam conditioning device of claim 24, wherein the proximal end of the nozzle body defines a shoulder surface, and when the outer valve stem is in the closed position the first nut is spaced away from the shoulder surface, and when the outer valve stem is in the open position the first nut is in contact with the shoulder surface.

26. The steam conditioning device of claim 24, wherein when the inner valve stem is in the closed position the second nut is spaced away from the first nut, and when the inner valve stem is in the open position the second nut is in contact with the first nut.

27. A spray nozzle, comprising:

a nozzle body having a proximal end, a distal end, a first through bore extending between the proximal and distal ends of the nozzle body, and an outer valve seat disposed at the distal end of the nozzle body;

an outer valve stem slidably disposed relative to the first through bore of the nozzle body and including a proximal end, a distal end, and an outer valve head, the outer valve head carrying an inner valve seat at the distal end of the outer valve stem, and a second through bore extending through at least a distal portion of the outer valve stem, the outer valve head adapted to engage the outer valve seat of the nozzle body when the outer valve stem is in a closed position and adapted to be spaced away from the outer valve seat of the nozzle body when the outer valve stem is in an open position;

an inner valve stem slidably disposed relative to the second through bore of the outer valve stem and including a proximal end, a distal end, and an inner valve head disposed at the distal end of the inner valve stem, the inner valve head adapted to engage the inner valve seat when the inner valve stem is in a closed position and adapted to be spaced away from the inner valve seat when the inner valve stem is in an open position;

an outer bias device generating a first force biasing the outer valve head of the outer valve stem toward the outer valve seat of the nozzle body;

an inner bias device generating a second force biasing the inner valve head of the inner valve stem toward the inner valve seat of the outer valve stem; and a nozzle coupler having a proximal end, a distal end and a third through bore extending between the proximal and distal ends of the nozzle coupler, the nozzle coupler fixed in the second through bore of the outer valve steam, the third through bore slidably receiving the inner valve stem and defining the inner valve seat at the distal end of the nozzle coupler, wherein the inner valve stem occupies the open position and the outer valve stem occupies the closed position upon the application of a first pressure on the distal ends of the inner and outer valve stems, and the inner and outer valve stems occupy the open positions upon the application of a second pressure that is greater than the first pressure on the distal ends of the inner and outer valve stems.

28. The spray nozzle of claim 27, wherein the second nut is coupled to the proximal end of the nozzle coupler and the second spring is disposed between the second nut and the nozzle coupler.

* * * * *